US009931561B2

(12) United States Patent
Zakem

(10) Patent No.: US 9,931,561 B2
(45) Date of Patent: Apr. 3, 2018

(54) ATHLETIC GARMENT WITH PROTECTIVE CUP POUCH

(71) Applicant: Tricot Mondial Inc., St-Laurent (CA)

(72) Inventor: Anthony Zakem, Montreal (CA)

(73) Assignee: TRICOT MONDIAL INC., St-Laurent, Quebec (CA)

( * ) Notice: Subject to any disclaimer, the term of this patent is extended or adjusted under 35 U.S.C. 154(b) by 0 days.

(21) Appl. No.: 15/532,331

(22) PCT Filed: Dec. 1, 2015

(86) PCT No.: PCT/CA2015/000588

§ 371 (c)(1),
(2) Date: Jun. 1, 2017

(87) PCT Pub. No.: WO2016/086288

PCT Pub. Date: Jun. 9, 2016

(65) Prior Publication Data

US 2017/0266537 A1 Sep. 21, 2017

Related U.S. Application Data

(60) Provisional application No. 62/086,833, filed on Dec. 3, 2014.

(51) Int. Cl.
*A41D 27/26* (2006.01)
*A63B 71/12* (2006.01)
(Continued)

(52) U.S. Cl.
CPC ..... *A63B 71/1216* (2013.01); *A41D 1/08* (2013.01); *A41D 13/0575* (2013.01);
(Continued)

(58) Field of Classification Search
CPC ..... A63B 71/1216; A41D 13/02; A41D 1/06; A41D 1/08; A41B 9/04
See application file for complete search history.

(56) References Cited

U.S. PATENT DOCUMENTS 2,058,970 A * 10/1936 Fiesh ..... A41B 9/02 2/403
2,266,062 A * 12/1941 Montmarquet ..... A61F 5/03 152/2

(Continued)

FOREIGN PATENT DOCUMENTS

CA 2905980 A1 10/2014

*Primary Examiner* — Tejash Patel
(74) *Attorney, Agent, or Firm* — Kagen Binder, PLLC

(57) ABSTRACT

An athletic garment is provided that has a plurality of fabric panels sewn together to form pants. The pants have a continuous interior cavity with a pair of leg portions each terminating at a leg opening. The pants have a front face and a rear face. A waistband is sewn to an upper edge of the pants. A fabric pouch is provided for containing an athletic support cup, and this pouch is disposed within the interior cavity of the pants proximate to the front face. The pouch is attached to the waistband by a top attachment panel, and it is attached to the front face of the pants on right and left sides of the pouch by side wing attachment panels. The side wing attachment panels are spaced apart from each other so as to leave a tip portion of the pouch unattached.

25 Claims, 7 Drawing Sheets

(51) Int. Cl.
*A41D 13/05* (2006.01)
*A41D 1/08* (2018.01)

(52) U.S. Cl.
CPC ..... *A41D 2400/22* (2013.01); *A41D 2400/34* (2013.01); *A41D 2400/60* (2013.01)

(56) References Cited

U.S. PATENT DOCUMENTS

| | | | | |
|---|---|---|---|---|
| 3,788,314 | A | 1/1974 | Noreen | |
| 4,141,357 | A * | 2/1979 | Dietz | A41B 9/023 602/68 |
| 4,922,899 | A * | 5/1990 | Graff | A61F 5/40 128/846 |
| 6,023,789 | A | 2/2000 | Wilson | |
| 6,820,284 | B2 * | 11/2004 | Horikoshi | A41B 9/023 2/400 |
| 7,216,371 | B2 * | 5/2007 | Wong | A41B 9/02 2/228 |
| 8,146,170 | B2 | 4/2012 | Goodhand et al. | |
| 8,887,316 | B2 | 11/2014 | Wong | |
| 2010/0024105 | A1 * | 2/2010 | Sims | A63B 71/1216 2/466 |
| 2012/0272440 | A1 | 11/2012 | Landi et al. | |

* cited by examiner

ATHLETIC GARMENT WITH PROTECTIVE CUP POUCH

PRIORITY CLAIM

This application claims benefit from International Application No. PCT/CA2015/000588, filed Dec. 1, 2015, which in turn claims priority to U.S. Provisional Patent Application having Ser. No. 62/086,833, filed on Dec. 3, 2014, both of which are incorporated herein by reference in their entireties for all purposes.

FIELD OF THE INVENTION

The invention relates to athletic garments and more particularly to garments adapted to contain a protective/support cup.

BACKGROUND OF THE INVENTION

For many sports applications, players wish to or may be required to wear a protective/support cup to prevent injury. In such sports, for example, hockey, it has been traditional for the player to wear a baselayer, over which a jock is worn to hold an athletic support cup, over which the player then layers other shorts and equipment.

This arrangement is cumbersome and expensive, in addition to being time-consuming to put on for each game or practice.

More recently, there have been products that combine a baselayer and jock. However, such designs have certain shortcomings as the jock portion may be either attached too rigidly to the pants, or separate elastic straps or loops may be provided that allow too much play and freedom for the pouch/cup making it easy for it to become dislodged or simply fail to provide the desired support. This may occur especially in hockey when the player does crossovers, skates backwards or brakes suddenly, or raises his leg. In a too tight arrangement, the player may be restricted from moving as he wishes to. In a too loose arrangement, the pouch and cup may flop around excessively or allow too much of a gap between the protective element and the wearer's body, leading to potentially painful misalignment and deficient protection.

It would be desirable to provide an improvement on this combined model that allows for both a range of motion and support.

SUMMARY OF THE INVENTION

According to a first aspect of the invention, an athletic garment is provided that has a plurality of fabric panels sewn together to form pants. The pants have a continuous interior cavity with a pair of leg portions each terminating at a leg opening. The pants have a front face and a rear face. A waistband is sewn to an upper edge of the pants. A fabric pouch is provided for containing an athletic support cup, and this pouch is disposed within the interior cavity of the pants proximate to the front face. The pouch is attached to the waistband by a top attachment panel, and it is attached to the front face of the pants on right and left sides of the pouch by side wing attachment panels. The side wing attachment panels are spaced apart from each other so as to leave a tip portion of the pouch unattached.

Preferably, the top attachment panel has a width extending at least along a full width of a top edge of the pouch. The top attachment panel may also be further attached partway along the side edges of the pouch.

In one embodiment, each of the side wing attachment panels extends along a portion of a side edge of the pouch. Preferably, each of the side wing attachment panels extends less than a full length of the side edge of the pouch.

The pouch may be provided with a flap opening for insertion or removal of the athletic support cup. Preferably, the side wing attachment panels are attached to the pouch below the flap opening.

The top attachment panel is preferably spaced away from the side wing attachment panels on the side edges of the pouch.

In one embodiment, the fabric panels of the leg portions are sewn to each other from one leg opening to the other with a continuous crotch seam. Preferably, the pouch is not directly attached to the continuous crotch seam.

One of the panels of the pants may comprise a roughly triangular panel disposed on the front face of the pants. The panel faces the pouch (i.e. it is "pouch-facing"). This panel may be bounded by the waistband, a pair of side seams, and the continuous crotch seam.

The panels may also include side panels disposed respectively on right and left sides of the pouch-facing panel. These two panels are preferably double-layer panels (i.e. having at least double layered fabric, or a fabric of at least double weight for greater compressive force). Each of these side panels may be joined to the pouch-facing panel by one of the side seams. (The pouch-facing panel is preferably single-panel or single weight.) These side panels serve as side walls to retain the pouch and its cup from the sides to keep them in a generally centered position. The pouch-facing panel itself is less compressive so that the pouch and its cup are not forced painfully into the wearer's genital area.

Another one of the panels comprises a sub-waistband panel which extends from one side seam on the front face of the pants around the rear face to the other side seam on the front face. This sub-waistband panel is preferably double-layer (i.e. having at least double layered fabric, or a fabric of at least double weight for greater compressive force). An advantage of this sub-waistband panel is that it retains the pants at the waist, especially when the wearer is bending downward, backward or to either side. The additional compressive force of the panel keeps the pants from sliding up or down, avoiding the need to provide an uncomfortably tight or overly restrictive waistband.

Preferably, the fabric panels of the pants, including the double-layer panels, include a resilient fabric selected for an overall compressive fit. As used herein, "resilient panels" includes the fabric panels of the pants, but does not include the attachment panels or any mesh panels, which may be (but are not necessarily) of a different fabric, weight or configuration. The resilient panels may include, for example, a blend of polyester and spandex (lycra/elastane). A preferred embodiment uses a polyester-spandex blend with at least 10% spandex, and more preferably at least 15% spandex. Preferably, the % spandex is less than about 30%.

Preferably, a single layer of the resilient fabric has a weight of at least 170 grams per square meter (GSM) (such that a double layer has a weight of 340 GSM), and more preferably at least 180 GSM (such that a double layer has a weight of 360 GSM).

In addition, each of the leg portions may include a mesh panel for breathability. The mesh panels may use a polyester-spandex blend with at least 10% spandex. Preferably, the mesh panels are perforated or formed with holes or gaps in the weave to vent sweat and assist with cooling. Mesh panels may also be provided elsewhere in the garment.

The top attachment panel and the side wing attachment panels may be of the same, or a slightly different, composition as the resilient fabric panels. In one preferred embodiment, these attachment panels are of a polyester-spandex blend with a lower % spandex than the resilient fabric panels. For example, the attachment panels may have 10% spandex, while the resilient fabric panels may have 15% spandex.

The resilient fabric may be particularly selected for antimicrobial and other properties. The resilient fabric may be particularly selected to be sweat-absorbent.

The pants may, for example, be configured as shorts (i.e. to the wearer's knee or less), or as full-length pants (i.e. extending approximately to the wearer's lower leg or ankle). The use of the term "pants" should not be taken as limiting in this sense. Further, the garment may be configured to be worn as a layer over underwear, or as a base layer without underwear. Other layers of clothing or equipment may be worn over the pants.

DETAILED DESCRIPTION

Embodiments of the athletic garment are shown in FIGS. 1-6. In the present description, relative terms such as "front", "rear", "upper", "lower", "right" and "left" and references to body parts are all with respect to a hypothetical wearer of the pants.

Figure 1:
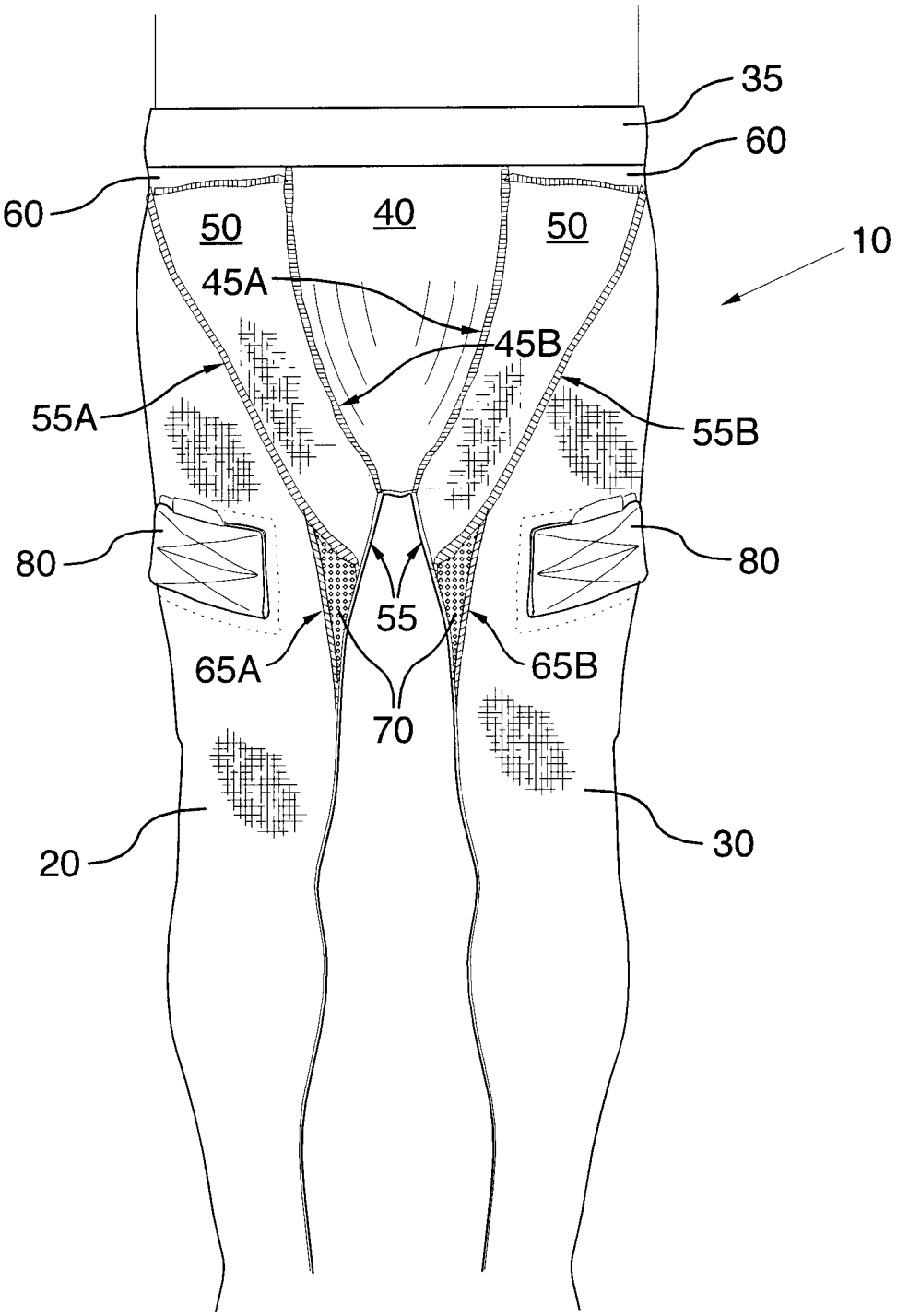
FIG. 1 is a front view of an embodiment of the athletic garment on a wearer.
Figure 2:
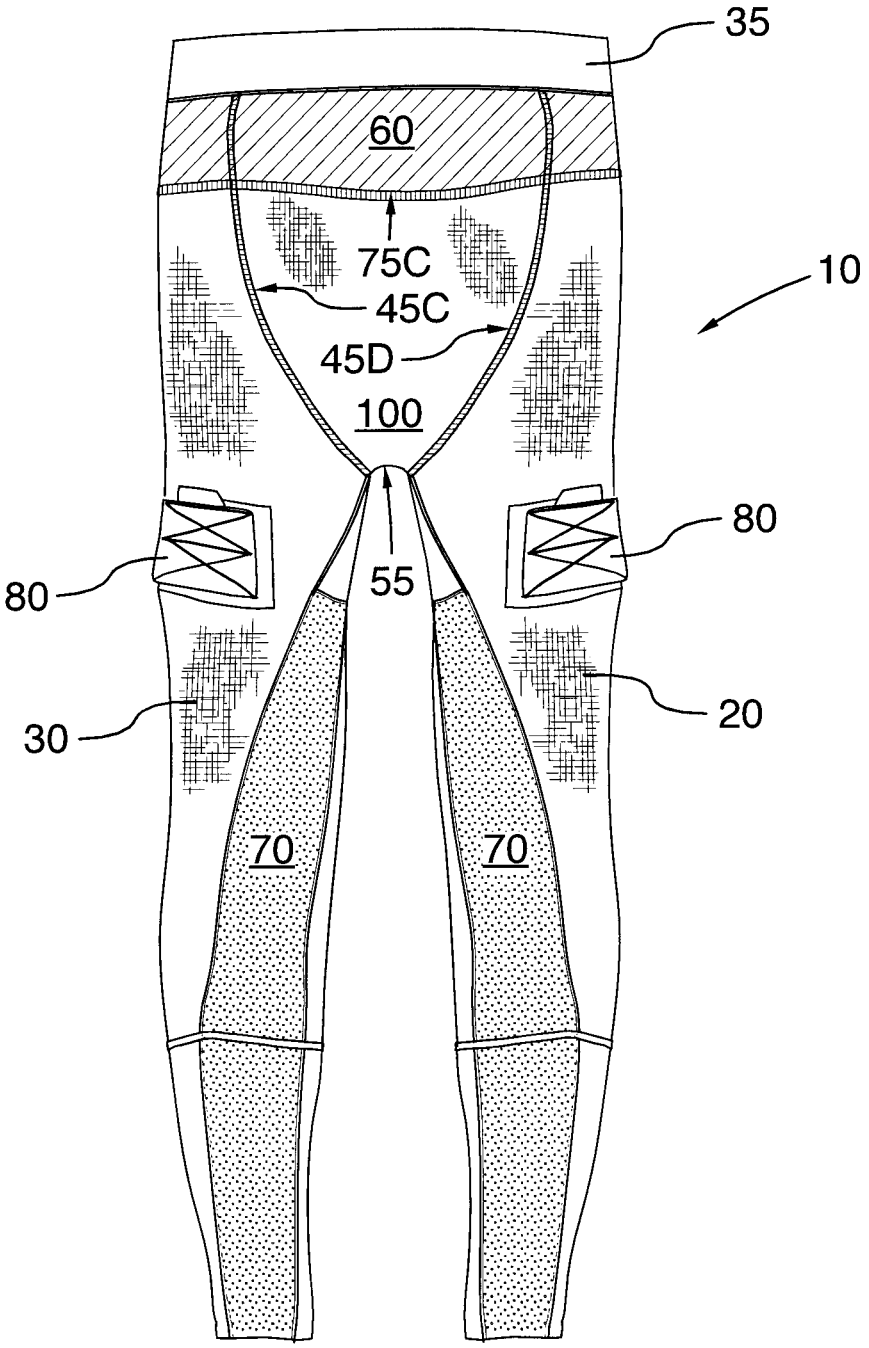
FIG. 2 is a rear view of an embodiment of the athletic garment on a wearer.
Figure 3:
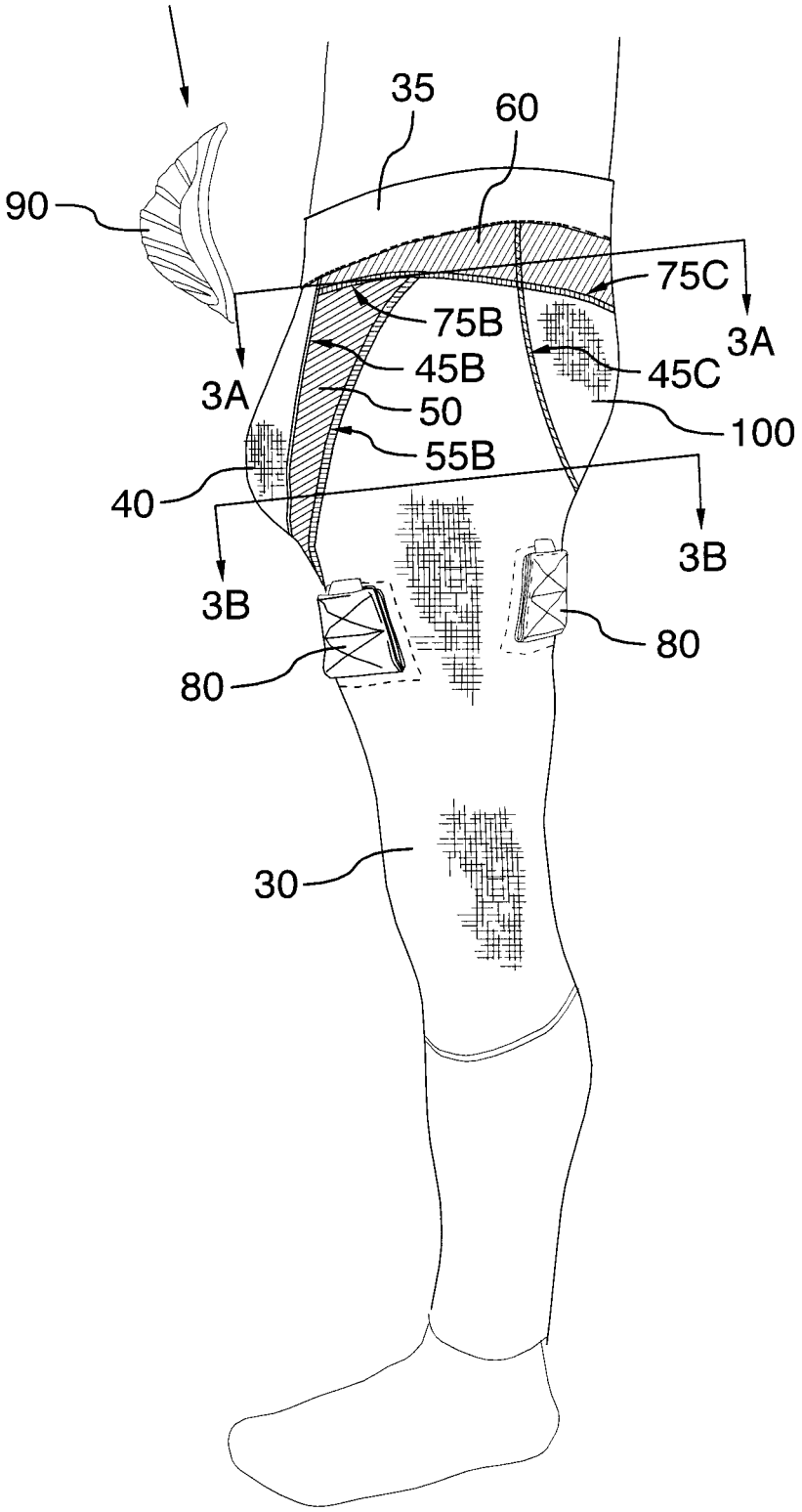
FIG. 3 is a side view of an embodiment of the athletic garment also showing cup 90.

FIGS. 1-3 show main sections of the outer construction of a preferred embodiment of the pants 10. FIG. 1 shows generally a front face of the pants. FIG. 2 shows generally a rear face of the pants. FIG. 3 shows generally a side view (both faces seen in part).

Pants 10 have generally a waistband 35, and a plurality of sewn panels to form the body of the pants. These include panels for the leg portions 20 and 30, as well as other specialty panels, which will now be described.

Below the waistband, a sub-waistband panel 60 is provided. As can be seen from FIGS. 1-3, panel 60 wraps most of the way around the front and back faces of the pants. This panel assists and supports the waistband.

In the front face, panel 40 connects (is sewn) directly to the waistband. This panel, as will be described in further detail below, covers generally the area where the athletic support cup pouch is provided on the interior. Accordingly, it is sometimes described herein as the "pouch-facing" panel 40. This panel 40 is roughly triangular, having a wider top (adjacent the waistband 35) and narrower point (between the legs, generally in the crotch area). The shape of this panel need not be precisely a triangle, but may be more of a trapezoidal shape, and in preferred embodiments, may have curved side and bottom edges generally following the lines of the body.

Beside the pouch-facing panel 40, on right and left sides, are side panels 50. These side panels 50 generally follow the contour of the pouch-facing panel 40 and provide transitional panels to the leg portion panels 20, 30 (which wrap around between the front and rear faces).

On the rear face, panel 100 is over the wearer's seat. Again, this may preferably generally follow contours of the wearer's body.

Completing the general description of the panels, mesh panels 70 may be provided on the inner legs (as seen in FIGS. 1-2) to promote breathability and airflow.

We next turn to a description of the seams used to connect the panels. A further description of the materials of the panels follows below.

Pouch-facing panel 40 is connected to side panels 50 with seams 45A, 45B. Side panels 50 are connected to leg portions 20, 30 at seams 55A, 55B respectively. The side panels also connect at their upper edge to the bottom of the sub-waistband panel 60 at seam segments 75A, 75B, 75C (shown in FIGS. 2 and 5) (in practice, these may be one continuous seam). A central continuous crotch seam 55 extends along the interior of the wearer's legs from one leg opening 22 to the other 32. Seams 45A, 45B also continue across the continuous crotch seam 55 onto the rear face as seams 45D, 45C (best seen in FIGS. 2 and 5). Leg portions 20, 30 connect to mesh panels 70 at seams 65A, 65B in the front, and 65C, 65D in the rear. The upper edge of the mesh panels 70 are also connected by seams 55A, 55B to the side panels 50. Seams 45C, 45D connect the leg portions 20, 30 to the seat panel 100. These seams 45C, 45D also extend up through the sub-waistband panel 60. Exemplary seams for a preferred construction have been described, but it will be appreciated that other constructions of panels and seams are possible with the overarching goal to make a functional, comfortable pair of close fitting pants.

Completing the description of the outer pants construction, external features such as front and rear hockey socks holders 80 may be provided as shown. While not shown, it will be appreciated that other features, such as external or integral pockets, may also be provided.

On the interior of the pants, a fabric pouch 110 is provided which can accommodate an athletic supporter (such as cup 90) or other padding or protective element(s). The placement of the pouch is seen generally in FIG. 4, which roughly covers the wearer's genital area. The pouch is made up of two faces of fabric (it will be appreciated that these faces may in fact be made up of one continuous, folded piece of fabric, or separate panels of fabric sewn together). Facing the wearer on the inside face is a slot or other opening in the pouch (at approximately location 115), which may be covered by a flap or other closure bearing a Velcro strip or other attachment device. The pouch may be roughly triangular or trapezoidal in shape (preferably having slightly rounded contoured sides as shown), and terminating in a blunt or rounded tip 112. The shape of the pouch may be selected to follow generally the shape and size of the athletic cup or other padding or protective gear to be accommodated.

This fabric pouch 110 is not sewn or attached directly to the pants, but is connected to the pants by intermediate attachment pieces of elastic fabric. These are (1) a top attachment panel 120; and (2) side wing attachment panels 130. The relatively wide width of the top and side wing attachment panels is preferred over narrow straps, as the compressive load is spread out over a wider area of the wearer's lower body, reducing the risk of mispositioning of the cup 90, or strap edges digging into the wearer in the course of dynamic movements, turns, cross-overs, hip movements, and leg pivots.

Figure 4:
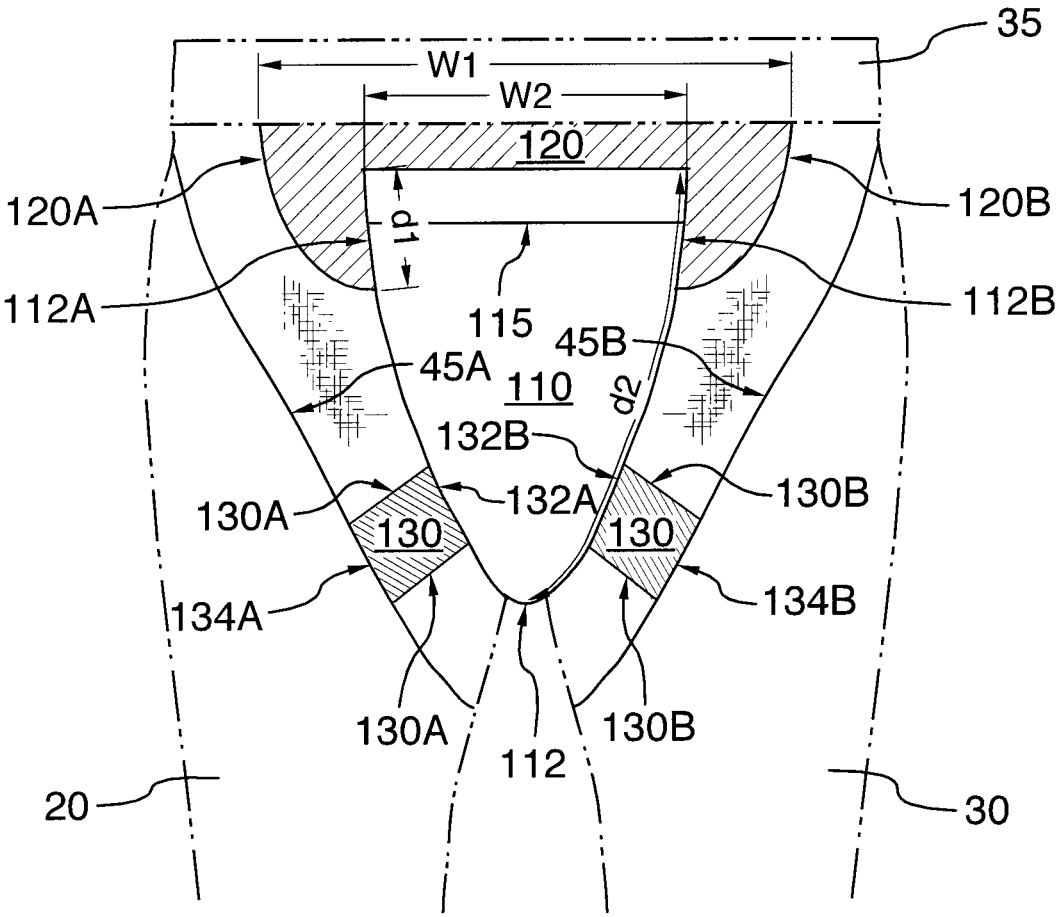
FIG. 4 is a detailed front view of the embodiment in FIG. 1 with outer panels removed to better expose the pouch 110 and the top attachment panel 120 and side wing attachment panels 130.
Figure 5:
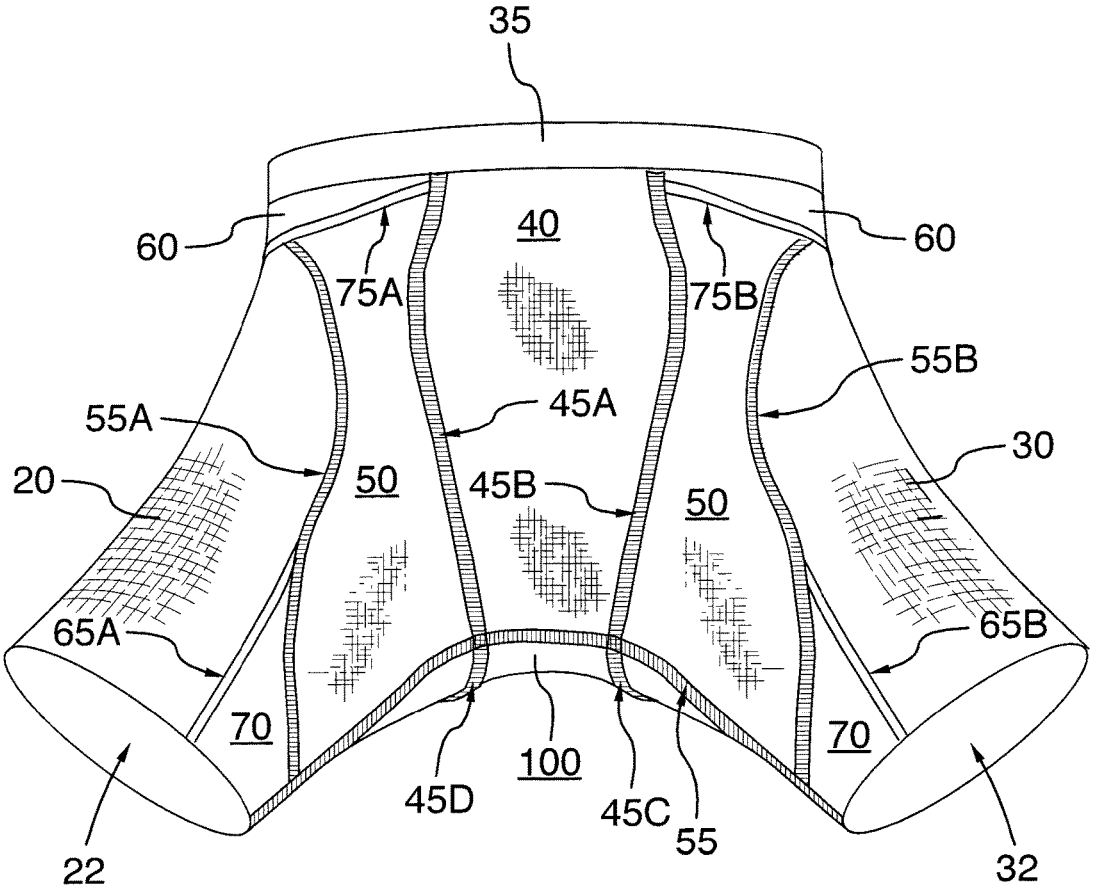
FIG. 5 is a truncated front view of the embodiment of FIG. 1 without a wearer and flared to show leg openings 22, 32 and continuous crotch seam 55.
Figure 6:
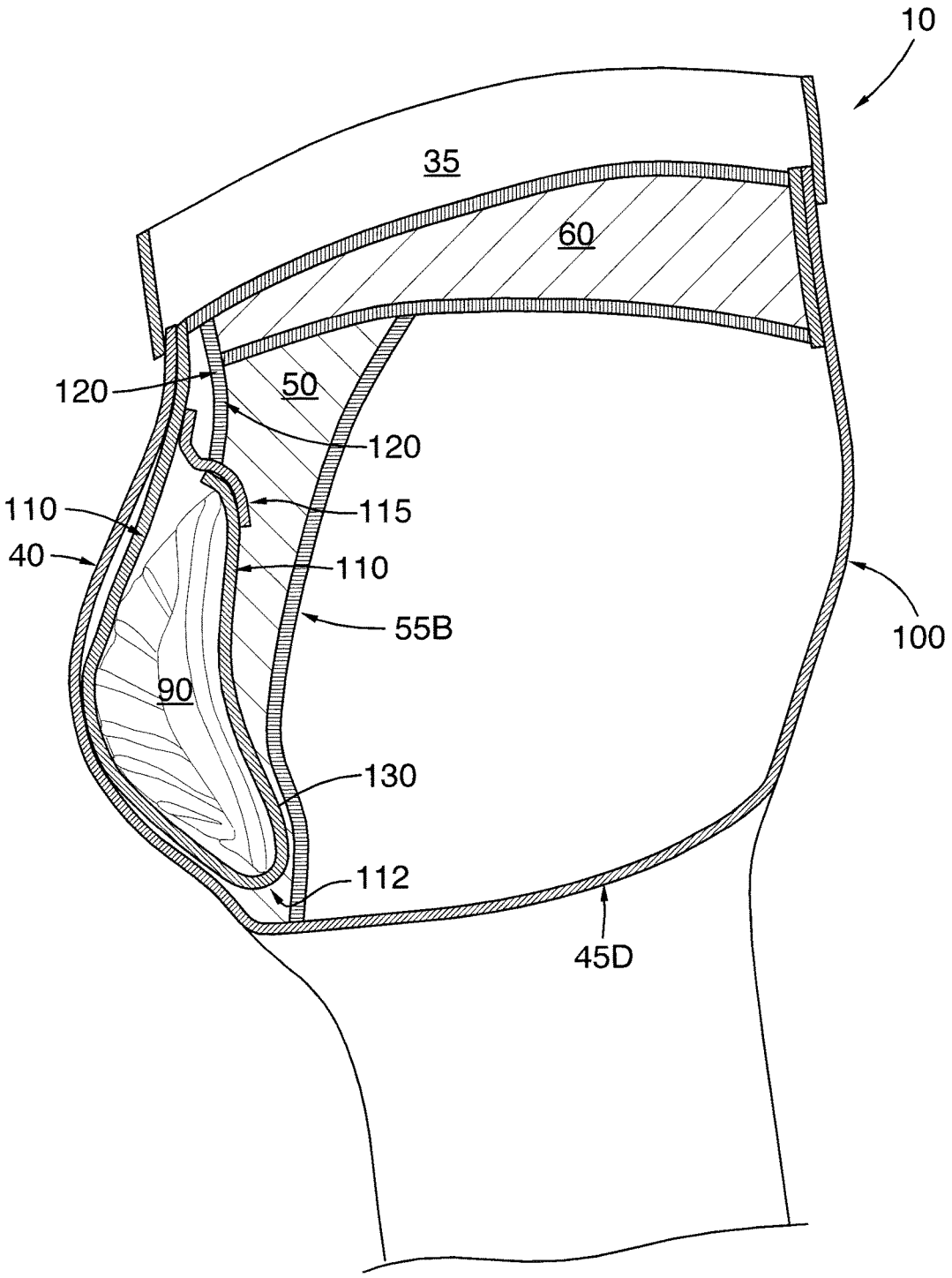
FIG. 6 is a sectional view through a central vertical axis of the pants showing cup 90 placement in the pouch 110 and associated layers of the various fabric panels.

Top attachment panel 120 is shown in FIG. 4. This connects to the waistband 35 at a top edge, and to the top and part of the sides of the pouch 110, as shown. The top attachment panel 120 extends at least along the width of the top edge of the pouch 120 (width w2), and more preferably, has a width extending beyond the pouch on both sides (width w1) as shown in FIG. 4. The top attachment panel 120 also preferably extends down the length of the pouch over distance d1 at seams 112A, 112B. Distance d1 is less than the full length of the pouch from its top to its tip (distance d2), but sufficient to extend beyond the flap opening line 115. The connection on the top and sides is intended to provide secure yet comfortable retention of the pouch on the inside of the pants. The side edges of the top attachment panel 120A, 120B are free (not attached to any part of the pants). This allows a certain degree of freedom to the pouch.

Side wing attachment panels 130, also shown in FIG. 4, attach the pouch to the body of the pants. Connected at one edge to the pouch at seams 132A, 132B, the wing panels are sewn at their other ends 134A, 134B to the pants at seams 45A, 45B respectively. It will be recalled that seams 45A, 45B are also the seams connecting the pouch-facing panel 40 to the side panels 50, as shown in FIG. 1. The side wing attachment panels are preferably wider than straps, and have free side edges 130A, 130B, for comfort. The side wing attachment panels 130 are also preferably spaced away from each other, and as shown the tip 112 of the pouch is not attached, either to the side wing attachment panels 130 or to the continuous crotch seam 55 of the pants. The tip of the pouch is intended to be loose. This can be seen quite clearly in the sectional view in FIG. 6. In practice, the side wing attachment panels 130 may not be precisely as shown in FIG. 4. They may not extend outward to the sides (i.e. pulling the pouch out tautly), but may be folded or curved back onto themselves. The side edges of the pouch may be more or less aligned with outer seams 45A, 45B of the pants, so that the attachment wings remain somewhat slack.

The side wing attachment panels are preferably spaced away from the top attachment panels, so that a good portion of the side edges of the pouch remains free.

So far, we have described the combination of the pouch and its attachment pieces as seemingly permitting fairly free movement. However, in practice, these will be retained to a great degree by the overall compressive fit of the pants, and specific compressive properties of certain double-layer panels to be described next.

Figure 3A:
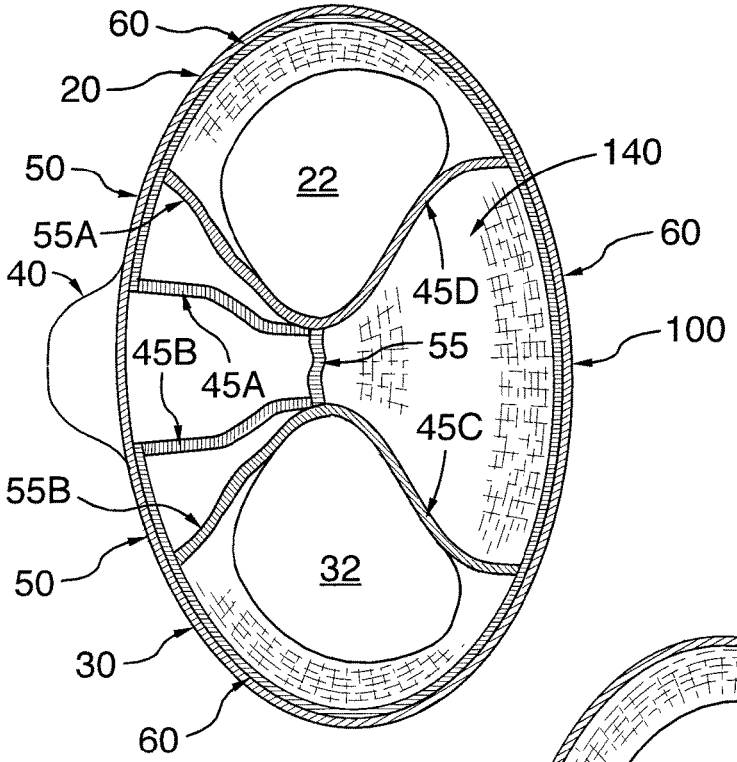
FIGS. 3A and 3B are cross-sectional views along lines 3A-3A and 3B-3B of FIG. 3, respectively. The cross-sectional views have the pouch and attachment panels removed to better illustrate the double-layer panels (i.e. those shown in shaded lines in FIG. 3).

Panels 60 and 50 are double-layer panels. This means that each of these panels is made of a double-thickness of fabric, or a single layer of higher weight (especially double-weight) fabric. These layers are best seen in the cross-sectional views in FIGS. 3A and 3B. As shown in FIG. 3A, there is a double-layer of fabric 60 extending almost all the way around the body of the pants. The double-layered fabric has a greater compression and acts as a retaining mechanism (in this case to keep the pants from sliding down in back, without needing to make a tighter waistband) allowing a full range of motion.

Figure 3B:
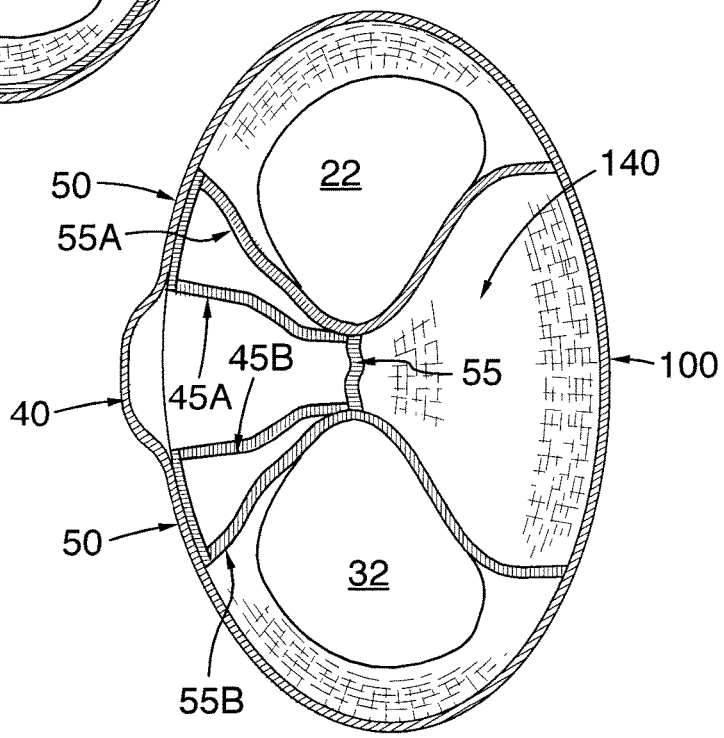

As shown in FIG. 3B, the side panels 50 are also double-layer panels. These act as side retaining walls on either side of the pouch facing panel 40. The pouch facing panel 40 is single-layer, not double. This is to allow the groin to be rested, while having auxiliary support. Combined with the overall compressive fit of the pants, these double-layer panels in particular keep the pouch and its cup from slipping or repositioning to the side, so that even if the attachment panels are somewhat loose and elastic, the extent of repositioning is kept in check. The overall construction therefore supports the jock from inside (through the pouch attachment panels) and outside (through the overall compressive fit, and the double-layer side panels of the pants).

In construction, the fabric panels are preferably made of a resilient fabric selected for an overall compressive fit. This may include, for example, a blend of polyester and spandex (lycra/elastane). A preferred embodiment uses a polyester-spandex blend with at least 10% spandex, and more preferably at least 15% spandex. Preferably, the % spandex is less than about 30%.

Preferably, a single layer of the resilient fabric has a weight of at least 170 GSM (such that a double layer has a weight of 340 GSM), and more preferably at least 180 GSM (such that a double layer has a weight of 360 GSM).

The mesh panels 70 may use a polyester-spandex blend with at least 10% spandex.

The top attachment panel 120 and the side wing attachment panels 130 may be of the same, or a slightly different, composition as the other fabric panels (i.e. panels 20, 50, 40, 30, 60, 70, 100). In one preferred embodiment, these attachment panels are of a polyester-spandex blend with a lower % spandex than the resilient fabric panels. For example, the attachment panels may have 10% spandex, while the resilient fabric panels may have 15% spandex.

The resilient fabric may be particularly selected (or treated as bulk fabric or as a completed garment) for antimicrobial, odour-free, and other properties (e.g. robustness over repeated washings—preferably up to at least approximately 50+ washes). For example, bio-dip processes may be used to achieve particular fabric properties. The resilient fabric may be particularly selected to be sweat-absorbent or moisture-wicking. One presently preferred fabric for such properties is the EX-DRY™ fabric available from Adidas (although many variations and alternatives are possible).

It will be appreciated that although male applications have been referenced expressly or impliedly, the present garment can also be modified for female applications, including female genital protective equipment. Further, it will be appreciated that although hockey applications have been discussed, numerous other sports applications are possible as well (e.g. without limitation, baseball, football and rugby, and other sports needing padding or protective cups). There may also be aspects of the construction of the pants which make them desirable to wear without a cup, simply for the support of the compressive pants themselves, and the particular arrangement of single- and double-layered panels.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations, and equivalents are intended to be included within the scope of a broad purposive construction.

What is claimed is:

1. An athletic garment comprising:

a plurality of fabric panels sewn together to form pants having a continuous interior cavity with a pair of leg portions each terminating at a leg opening, the pants having a front face and a rear face;

a waistband sewn to an upper edge of the pants;

a fabric pouch for containing an athletic support cup disposed within the interior cavity of the pants proximate to the front face, the pouch being attached:

to the waistband by a top attachment panel; and to the front face of the pants on right and left sides of the pouch by side wing attachment panels, wherein the pouch extends downward from the waistband and terminates in a tip portion, and the side wing attachment panels are spaced apart from the tip portion and are spaced apart from each other so as to leave the tip portion of the pouch unattached.

2. The athletic garment of claim 1, wherein the top attachment panel has a width extending at least along a full width of a top edge of the pouch.

3. The athletic garment of claim 1, wherein each of the side wing attachment panels extends along a portion of a side edge of the pouch.

4. The athletic garment of claim 3, wherein each of the side wing attachment panels extends less than a full length of the side edge of the pouch.

5. The athletic garment of claim 1, wherein the pouch has a flap opening for insertion or removal of the athletic support cup.

6. The athletic garment of claim 5, wherein the side wing attachment panels are attached to the pouch below the flap opening.

7. The athletic garment of claim 1, wherein the top attachment panel is further attached partway along the side edges of the pouch.

8. The athletic garment of claim 7, wherein the top attachment panel is spaced away from the side wing attachment panels on the side edges of the pouch.

9. The athletic garment of claim 1, wherein the fabric panels of the leg portions are sewn to each other from one leg opening to the other with a continuous crotch seam.

10. The athletic garment of claim 9, wherein the pouch is not directly attached to the continuous crotch seam.

11. The athletic garment of claim 9, wherein one of the panels comprises a roughly triangular pouch-facing panel disposed on the front face of the pants and bounded by the waistband, a pair of side seams, and the continuous crotch seam.

12. The athletic garment of claim 11, wherein two of the panels comprise double-layer side panels, disposed respectively on right and left sides of the pouch-facing panel, each being joined to the pouch-facing panel by one of the side seams.

13. The athletic garment of claim 12, wherein one of the panels comprises a sub-waistband double-layer panel which extends from one side seam on the front face of the pants around the rear face to the other side seam on the front face.

14. The athletic garment of claim 13, wherein the fabric panels, including the double-layer panels, include a resilient fabric selected for an overall compressive fit.

15. The athletic garment of claim 14, wherein the resilient fabric includes a polyester-spandex blend.

16. The athletic garment of claim 15, wherein the polyester-spandex blend includes at least 10% spandex.

17. The athletic garment of claim 14, wherein a single layer of the resilient fabric has a weight of at least 170 GSM.

18. The athletic garment of claim 1, wherein each of the leg portions includes a mesh panel for breathability.

19. The athletic garment of claim 14, wherein the top attachment panel and the side wing attachment panels are of a different composition from the resilient fabric panels.

20. The athletic garment of claim 19, wherein the top attachment panel and the side wing attachment panels are of a polyester-spandex blend with a lower % spandex than the resilient fabric panels.

21. The athletic garment of claim 14, wherein the resilient fabric is antimicrobial.

22. The athletic garment of claim 14, wherein the resilient fabric is moisture-wicking.

23. The athletic garment of claim 14, wherein the resilient fabric is breathable.

24. The athletic garment of claim 1, wherein the pants are configured as shorts.

25. The athletic pant of claim 1, wherein the pants are configured as full-length pants.

* * * * *